US006437726B1

(12) United States Patent
Price

(10) Patent No.: US 6,437,726 B1
(45) Date of Patent: Aug. 20, 2002

(54) METHOD AND APPARATUS FOR DETERMINING THE LOCATION OF UNDERGROUND OBJECTS DURING A DIGGING OPERATION

(75) Inventor: Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/726,905

(22) Filed: Nov. 30, 2000

(51) Int. Cl.[7] ..... G01S 13/88; G01S 13/04

(52) U.S. Cl. ..... 342/22; 342/27; 342/175; 342/195; 342/357.01; 342/357.06; 342/357.08; 37/348; 37/413; 701/200; 701/207; 701/213

(58) Field of Search ..... 342/21, 22, 27, 342/28, 165, 173, 174, 175, 195, 70, 71, 72, 357.01–357.17; 37/347, 348, 381, 382, 411, 413; 701/200, 207, 213

(56) References Cited

U.S. PATENT DOCUMENTS

| | | | | |
|---|---|---|---|---|
| 3,745,575 A | * | 7/1973 | Kikuchi | 342/22 |
| 3,775,765 A | * | 11/1973 | Di Piazza et al. | 342/22 |
| 4,072,942 A | * | 2/1978 | Alongi | 342/22 |
| 4,600,356 A | | 7/1986 | Bridges et al. | |
| 5,357,253 A | * | 10/1994 | Van Etten et al. | 342/22 |
| 5,592,092 A | | 1/1997 | Mechler | |
| 5,647,439 A | | 7/1997 | Burdick et al. | |
| 5,673,050 A | * | 9/1997 | Moussally et al. | 342/22 |
| 5,704,142 A | | 1/1998 | Stump | |
| 5,812,081 A | * | 9/1998 | Fullerton | 342/21 |
| 6,076,030 A | | 6/2000 | Rowe | |
| 6,282,477 B1 | | 8/2001 | Gudat et al. | |

FOREIGN PATENT DOCUMENTS

GB 2337120 A 10/1999

OTHER PUBLICATIONS

Publication US 2001/0017545 A1; Pub. Date: Aug. 30, 2001 Mercer, et al.

* cited by examiner

*Primary Examiner*—Bernarr E. Gregory
(74) *Attorney, Agent, or Firm*—Steve D. Lundquist

(57) ABSTRACT

A method and apparatus for determining a location of an underground object during a digging operation. The method and apparatus includes delivering a signal toward the underground object, receiving a reflected signal from the underground object, determining an initial location of the underground object, creating a region of uncertainty around the underground object as a function of a level of confidence of the determined initial location, performing at least one process to improve the level of confidence, and adjusting the region of uncertainty as a function of the improved level of confidence.

20 Claims, 8 Drawing Sheets

METHOD AND APPARATUS FOR DETERMINING THE LOCATION OF UNDERGROUND OBJECTS DURING A DIGGING OPERATION

TECHNICAL FIELD

This invention relates generally to a method and apparatus for locating underground objects during a digging operation and, more particularly, to a method and apparatus for determining the location of underground objects with an improved level of confidence during digging.

BACKGROUND ART

Earthworking machines, such as backhoes and excavators, are used to dig the earth. During the digging process, it is critical to avoid contact with underground objects such as pipes and lines. However, it is difficult, if not impossible, to know the exact locations of underground objects, and thus digging is slowed down substantially as the digging implement approaches what is believed to be the approximate location of the object to be avoided.

Advances in technologies, such as ground penetrating radar (GPR), have allowed earthworking operators some degree of confidence in determining the locations of underground objects. However, GPR cannot be used to determine the locations of underground objects with accuracy, due to variable propagation characteristics of the soil, and also due to the inherent two dimensional characteristics of the GPR signals.

The present invention is directed to overcoming one or more of the problems as set forth above.

DISCLOSURE OF THE INVENTION

In one aspect of the present invention a method for determining a location of an underground object during a digging operation is disclosed. The method includes the steps of delivering a signal toward the underground object, receiving a reflected signal from the underground object, determining an initial location of the underground object, creating a region of uncertainty around the underground object as a function of a level of confidence of the determined initial location, performing at least one process to improve the level of confidence, and adjusting the region of uncertainty as a function of the improved level of confidence.

In another aspect of the present invention an apparatus for determining a location of an underground object during a digging operation is disclosed. The apparatus includes means for delivering a signal toward the underground object and for receiving a corresponding reflected signal from the underground object, and a controller adapted to determine an initial location of the underground object, create a region of uncertainty around the underground object as a function of a level of confidence of the determined initial location, perform at least one process to improve the level of confidence, and adjust the region of uncertainty as a function of the improved level of confidence.

BEST MODE FOR CARRYING OUT THE INVENTION

Figure 1:
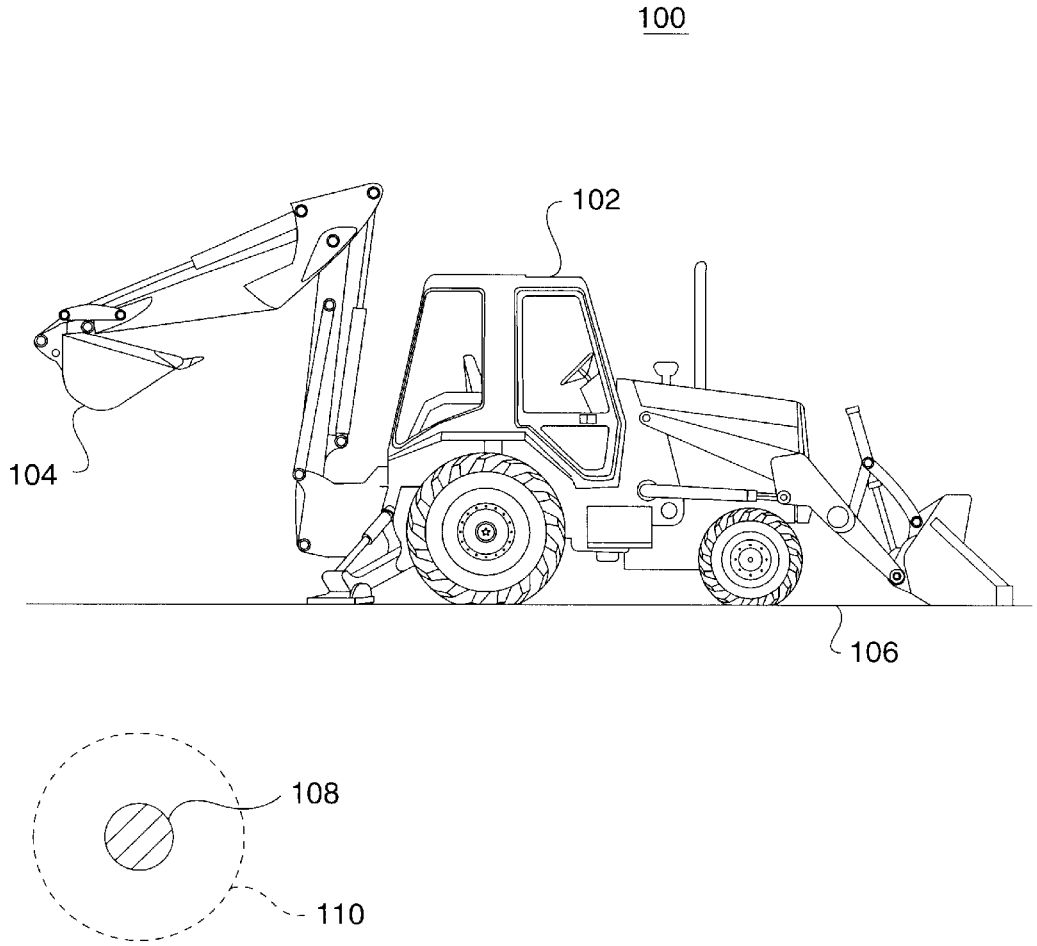
FIG. 1 is a diagrammatic illustration of a preferred embodiment of the present invention.

Referring to the drawings, a method and apparatus 100 for determining a location of an underground object during a digging operation is shown. With particular reference to FIG. 1, a work machine 102 is used to perform the digging operation. The work machine 102 is depicted as a backhoe loader, having a work implement 104 attached, preferably shown as a bucket. However, other types of work machines, e.g., excavators, front shovels, augers, trenchers, and the like, may be used with the present invention. In addition, other types of work implements, e.g., boring tools, trenching tools, blades, and the like, may also be used.

Typically, the work machine 102 is used to dig into the ground 106, e.g., soil, sand, rock, and various other types of material which may be classified as ground 106. It is often the case in the construction and earthworking industries that the digging operation takes place in the proximity of at least one underground object 108. For example, utility lines and pipes, underground tanks, and even military ordinance may be located in the ground 106 at the location at which digging is to take place.

The present invention is described below with reference to the flow diagrams depicted in FIGS. 6–9 to describe a preferred method of the present invention, and with periodic reference to FIGS. 2–5 to illustrate an accompanying preferred apparatus 100 of the present invention.

Figure 4:
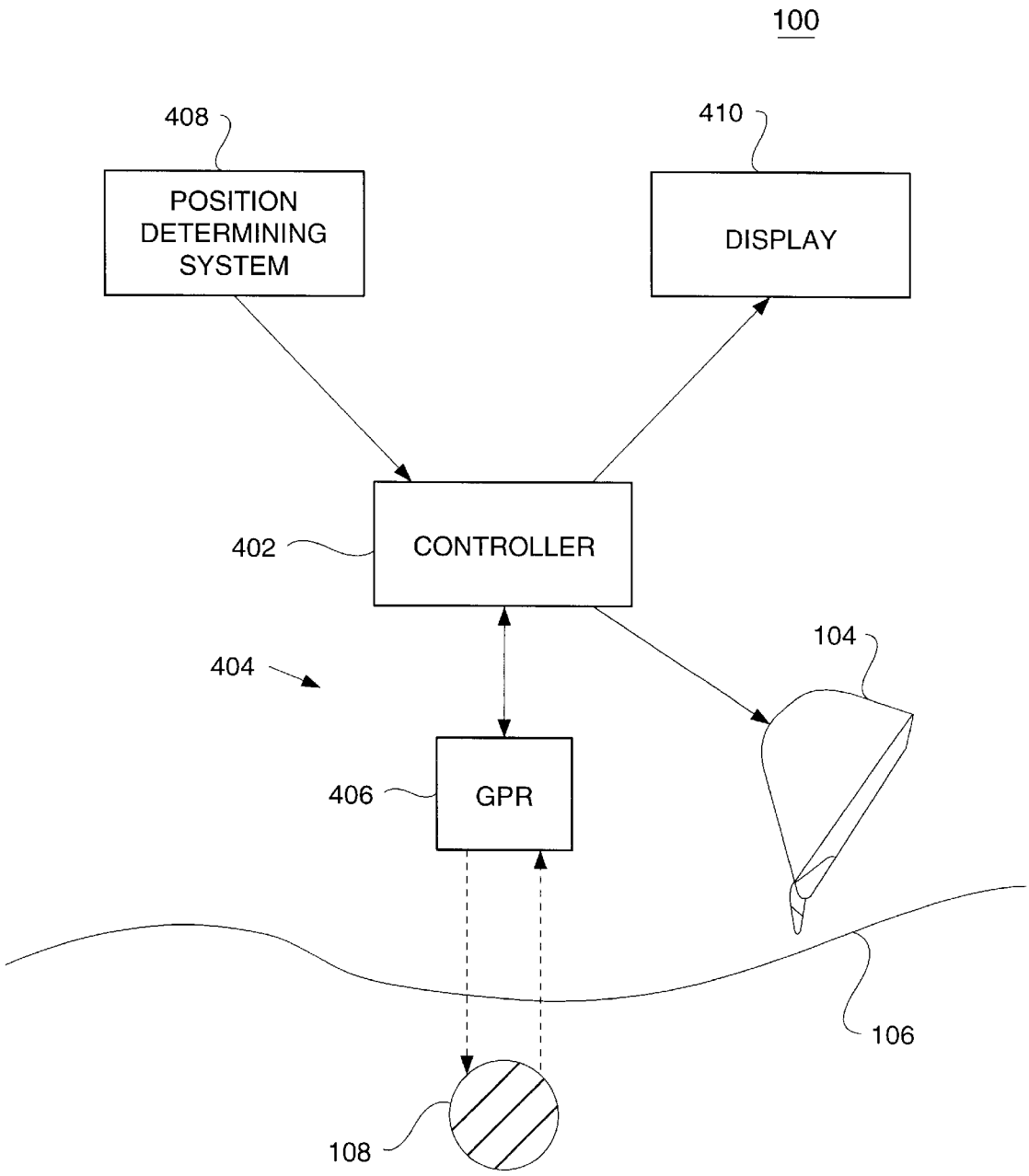
FIG. 4 is a block diagram illustrating a preferred apparatus suited for use with the present invention.
Figure 6:
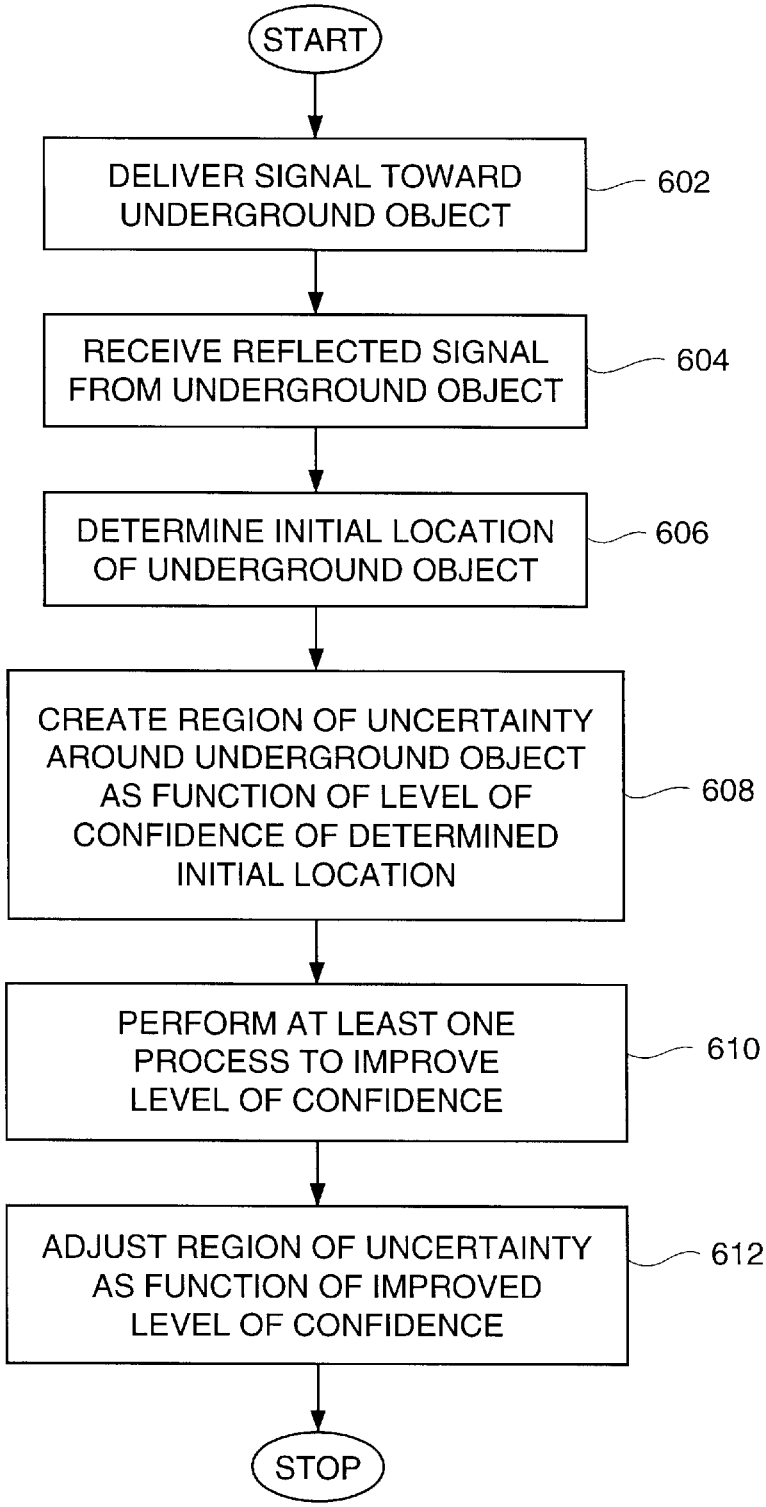
FIG. 6 is a flow diagram illustrating a preferred method of the present invention.

Referring to FIG. 6, in a first control block 602, a signal is delivered toward the underground object 108. In a second control block 604, a reflected signal is received from the underground object 108. The signal, as shown in FIG. 4, is delivered and received by a means 404 for delivering and receiving a signal, preferably a ground penetrating radar (GPR) antenna 406. Alternatively, other means 404 for delivering and receiving a signal, such as acoustic, ultrasonic, and the like, may be used without deviating from the scope of the present invention. For purposes of explanation of the present invention, however, the means 404 for delivering and receiving a signal is referred to below as a GPR antenna 406.

In a third control block 606, an initial location of the underground object 108 is determined. Preferably, the initial location is determined with respect to a depth in the ground 106, and a location relative to the dig location of the work implement 104.

In a fourth control block 608, a region of uncertainty 110 is created around the underground object 108 as a function of a level of confidence of the determined initial location. The level of confidence is preferably a function of how accurate the initial determined location is believed to be, and depends on such factors as the known dielectric constant of the ground 106 (discussed in more detail below), the amount of detail obtained from the GPR signal (also discussed in more detail below), and the like. In the preferred embodiment, the size of the region of uncertainty 110 is inversely proportional to the level of confidence, i.e., as the level of confidence increases, the size of the region of uncertainty 110 decreases.

In a fifth control block 610, at least one process is performed to improve the level of confidence. Examples of processes which may be used are discussed in detail below. As the level of confidence is improved, control proceeds to a sixth control block 612, in which the region of uncertainty 110 is adjusted as a function of the improved level of confidence, as described above.

Referring to FIG. 4, a controller 402 is preferably used to perform the controlling functions of the present invention. The controller 402 is preferably microprocessor based, and is adapted to control operation of the GPR antenna 406, and to receive GPR signals as they are received from the underground object 108. The controller 402 is also adapted to determine the initial location of the underground object 108, determine the region of uncertainty 110, and adjust the region of uncertainty 110 as a function of the level of confidence.

A position determining system 408, for example a geo-referenced position determining system, preferably located on the work machine 102, is adapted to determine the position of the work implement 104 by methods which are well known in the art. For example, in a backhoe loader having a boom, stick, and a bucket, a position determining system, such as a global positioning satellite (GPS) system, used in cooperation with various machine position sensors, may be used to determine the position of the bucket in geographical coordinates.

The position information from the position determining system 408 is delivered to the controller 402, which is further adapted to control the movement and position of the work implement 104.

A display 410 may be used to provide a visual indication of the location of at least one of the work implement 104, the underground object 108, and the region of uncertainty 110 relative to the ground 106, i.e., relative to the work machine 102 situated on the ground 106. The display 410 may be located on the work machine 102 for viewing by an operator or may be located at a remote site for monitoring by someone else.

Figure 2:
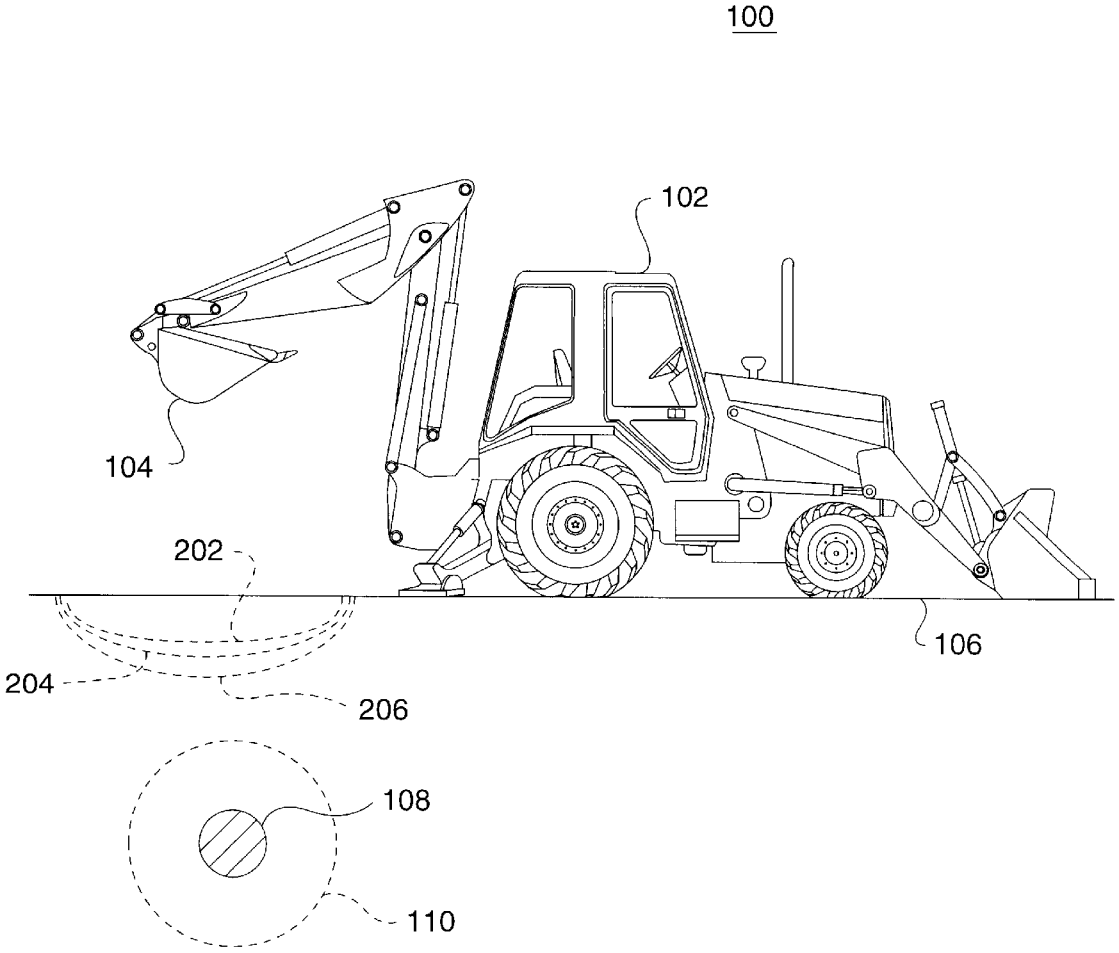
FIG. 2 is a diagrammatic illustration of one aspect of the present invention.
Figure 7:
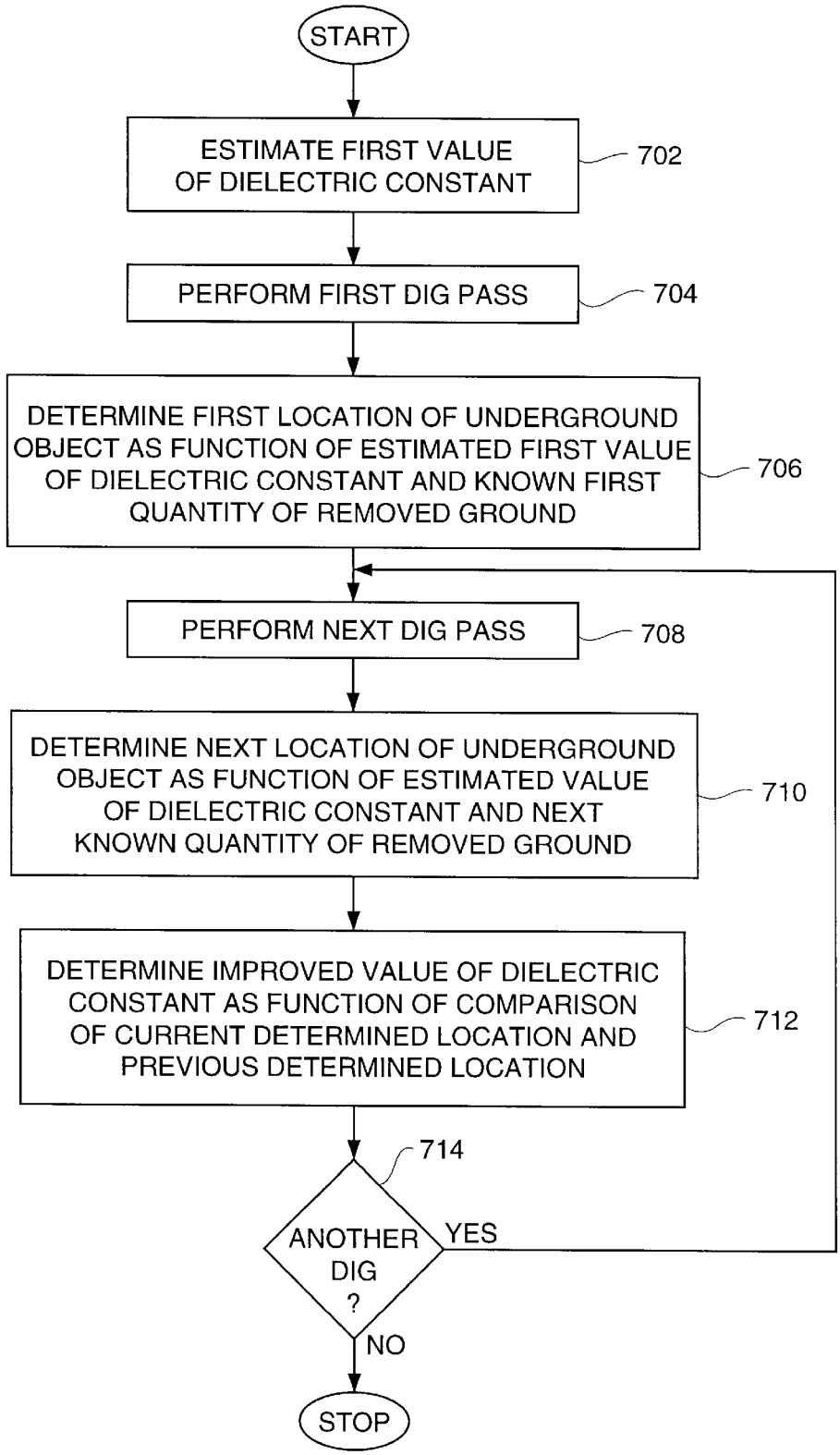
FIG. 7 is a flow diagram illustrating a preferred method associated with the aspect of FIG. 2.

Referring to FIG. 7, and with reference to FIG. 2, a preferred method for a process to improve the level of confidence is disclosed.

In a first control block 702, a first value of a dielectric constant of the ground 106 is estimated based on an assumption of properties of the ground 106. As is well known in GPR theory, the propagation velocity of the signal, as it passes through the ground 106, is generally a function of the dielectric constant of the material comprising the ground 106. The dielectric constant, therefore, is an important parameter to determine with accuracy the distance a GPR signal travels to the underground object 108 and back. However, it is difficult to know the value of dielectric constant with accuracy without conducting prior tests, which are costly and time consuming. Therefore, the assumption of the first value of dielectric constant is made as a best estimate, based on past experience with soil conditions.

In a second control block 704, a first dig pass is performed. Typically, in a digging operation, many dig passes will be required to accomplish the task.

In a third control block 706, a first location of the underground object 108 is determined as a function of the estimated first value of dielectric constant and a known first quantity of removed ground 106. The first quantity of removed ground 106 is readily determined by knowing the position of the work implement 104, as described above with reference to the position determining system 408, and by knowing the physical dimensions of the work implement 104. As shown in FIG. 2, the first quantity of removed ground 106 is depicted as first dig pass 202.

In a fourth control block 708, a next dig pass is performed, i.e., as represented by the second dig pass 204 in FIG. 2. During the next dig pass, a next known quantity of ground 106 is removed.

In a fifth control block 710, a next location of the underground object 108 is determined as a function of the estimated value of the dielectric constant and the next known quantity of removed ground 106. Since the second dig pass 204 in effect moves the surface of the ground 106 closer to the underground object 108, the next determined location of the underground object should in theory be the initial location minus the amount of ground 106 removed. However, the GPR signal should be more accurate due to the closer proximity, and consequently any error in the estimated value of dielectric constant will be embodied as a difference in value from the initial determined location of the underground object 108 and the next determined location of the underground object 108.

Therefore, in a sixth control block 712, an improved value of dielectric constant is determined as a function of a comparison of the current determined location of the underground object 108 with the previous determined location of the underground object 108.

In a first decision block 714, if another dig pass is to be made, control proceeds to the fourth control block 708, and loops through the fourth control block 708, the fifth control block 710 and the sixth control block 712 until no more dig passes are to be made. As exemplified in FIG. 2, a third dig pass 206 is made, and so forth until digging is complete. During these cycles, the determined location of the underground object 108 at each dig pass is compared to the determined location at the previous dig pass, and a new value of dielectric constant is determined. In this way, the dielectric constant, by repeated iterations, approaches a more accurate value, resulting in more accurate determinations of the actual location of the underground object 108, and the level of confidence becomes higher. Consequently, the region of uncertainty 110 is reduced, and the digging operation is free to approach the underground object 108 more closely and accurately.

Figure 3:
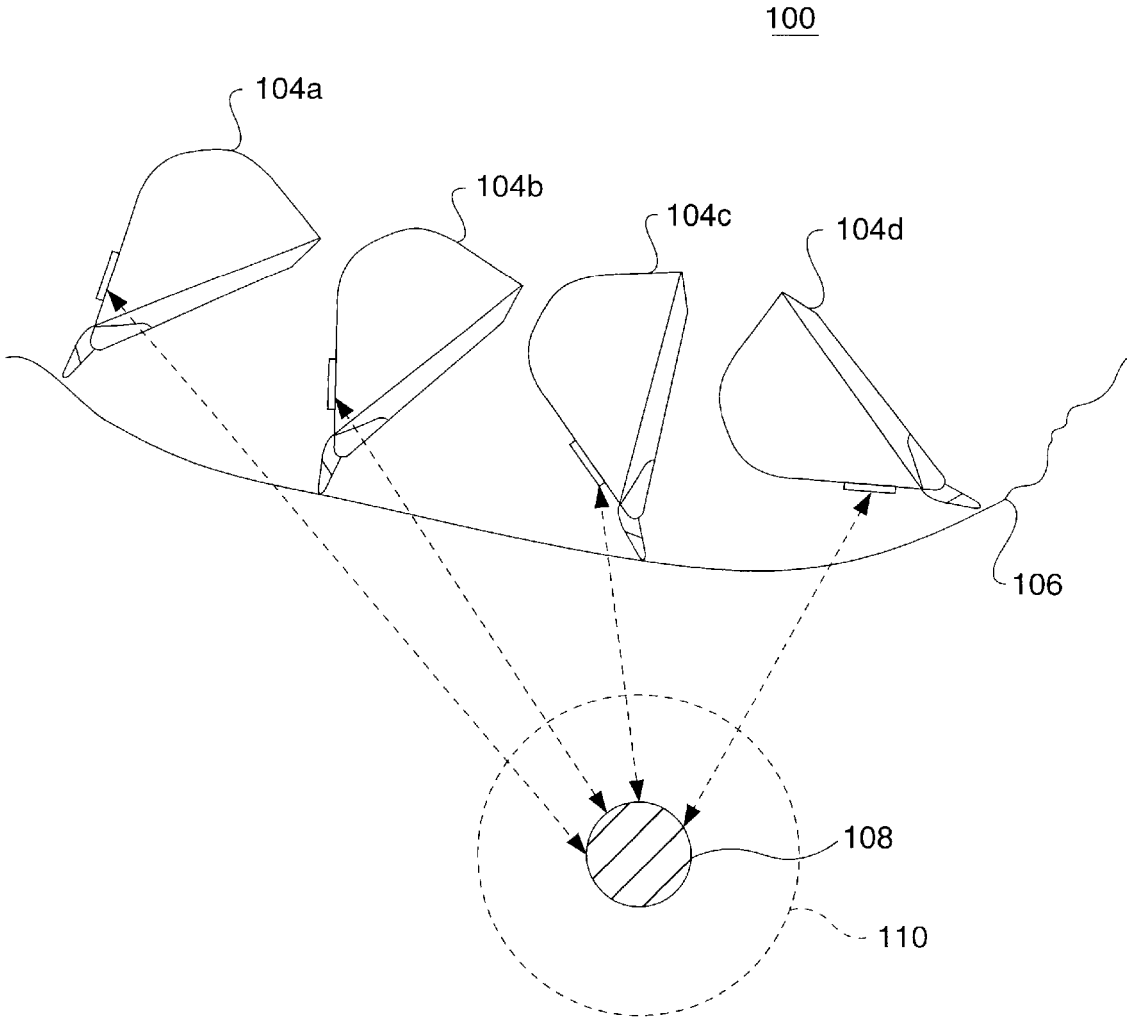
FIG. 3 is a diagrammatic illustration of another aspect of the present invention.
Figure 8:
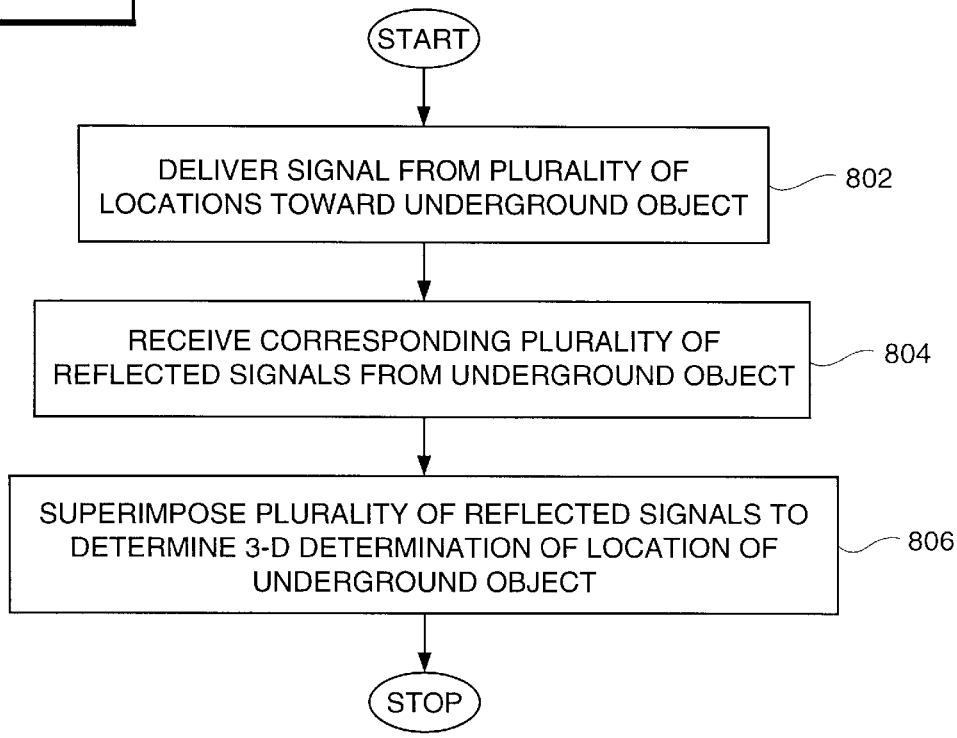
FIG. 8 is a flow diagram illustrating a preferred method associated with the aspect of FIG. 3.

Referring to FIG. 8, and with reference to FIG. 3, a preferred method for another process to improve the level of confidence is disclosed.

In a first control block 802, the GPR signal is delivered from a plurality of locations toward the underground object 108. As embodied in FIG. 3, this may be accomplished by mounting the GPR antenna 406 directly to the work implement 104. Thus, as the work implement 104 moves in an arc to perform a dig pass (as shown by 104*a,b,c,d*), the GPR antenna 406 directs the GPR signal from several positions. The controller 402 preferably directs the GPR antenna 406 as to the rate of repetition of the delivered signals.

In a second control block 804, a corresponding plurality of reflected signals are received from the underground object 108. The plurality of reflected signals are then superimposed in a third control block 806 to determine a three-dimensional location of the underground object 108, and to determine a size and shape of the underground object 108. The plurality of received GPR signals and the superimposed three-dimensional determined location of the underground object 108 offer a more accurate determination of the location of the underground object 108. Therefore, the level of confidence is increased, thus resulting in a reduced region of uncertainty 110. Furthermore, the three-dimensional determination of the size and shape of the underground object 108 provides an improved means of recognizing the identity of the underground object 108.

Figure 5:
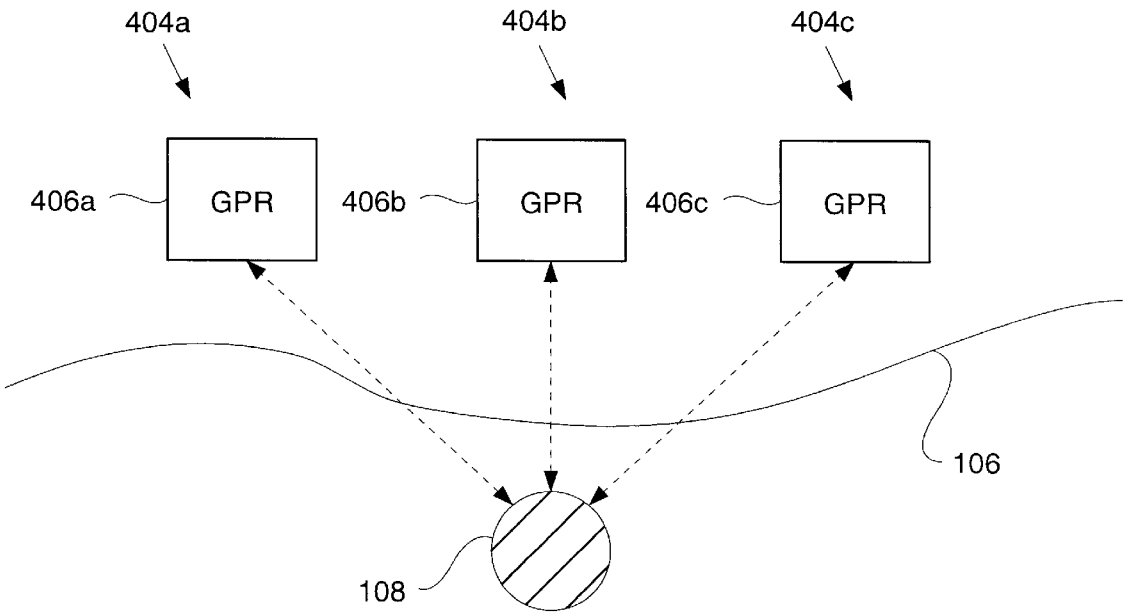
FIG. 5 is a diagrammatic illustration of yet another aspect of the present invention.
Figure 9:
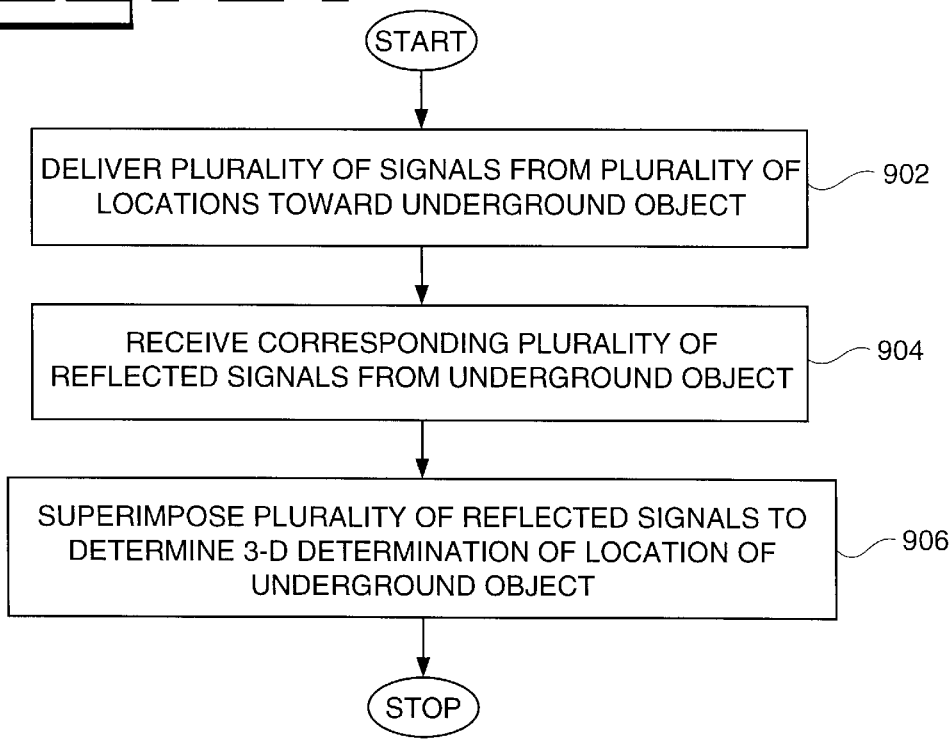
FIG. 9 is a flow diagram illustrating a preferred method associated with the aspect of FIG. 5.

Referring to FIG. 9, and with reference to FIG. 5, an alternative embodiment to the method described in FIG. 8 is shown.

In a first control block 902, a plurality of GPR signals from a plurality of locations are delivered toward the underground object 108. For example, as shown in FIG. 5, a plurality of GPR antennas 406*a*,406*b*,406*c* are located at fixed positions, each GPR antenna 406 delivering a signal toward the underground object 108. Although FIG. 5 shows three GPR antennas, any desired quantity may be used. The GPR antennas 406 may be mounted at various locations on the work machine 102, may be located in fixed position at locations remote from the work machine 102, or any combination of the above. Furthermore, one or more GPR antennas 406 may be mounted on the work implement 104 to achieve a combination of the present embodiment and the embodiment described with reference to FIG. 8. In the preferred embodiment, the controller 402 is adapted to coordinate the delivery of GPR signals from each of the GPR antennas 406 to the underground object 108.

In a second control block 904, a corresponding plurality of reflected signals are received from the underground object 108. The plurality of reflected signals are then superimposed in a third control block 906 to determine a three-dimensional location of the underground object 108, and to determine a size and shape of the underground object 108.

Industrial Applicability

As an example of an application of the present invention, an operator of a work machine 102, such as a backhoe loader, must work with caution to avoid underground objects 108 as digging takes place. The advent of GPR technology allows the operator some assurance that an underground object 108 is located within a certain area, but inaccuracies exist due to unknowns, such as characteristics of the ground 106, e.g., the dielectric constant of the ground 106.

The present invention is adapted to overcome these problems by using information obtained during the digging operations to improve the accuracy of locating underground objects 108, and thus to increase the confidence level of the machine operator as to the location of any objects to be avoided. Other aspects, objects, and features of the present invention can be obtained from a study of the drawings, the disclosure, and the appended claims.

What is claimed is:

1. A method for determining a location of an underground object during a digging operation, including the steps of:

delivering a signal toward the underground object;

receiving a reflected signal from the underground object;

determining an initial location of the underground object;

creating a region of uncertainty around the underground object as a function of a level of confidence of the determined initial location;

performing at least one process to improve the level of confidence; and adjusting the region of uncertainty as a function of the improved level of confidence.

2. A method, as set forth in claim 1, wherein performing at least one process includes the steps of:

a) estimating a first value of dielectric constant of the ground to be dug;

b) performing a first dig pass;

c) determining a first location of the underground object as a function of the estimated first value of dielectric constant and a known first quantity of removed ground;

d) performing a next dig pass;

e) determining a next location of the underground object as a function of the estimated value of dielectric constant and a next known quantity of removed ground;

f) determining an improved value of dielectric constant as a function of a comparison of the current determined location and a previous determined location; and g) repeating steps d) through f) for each subsequent dig pass.

3. A method, as set forth in claim 2, wherein performing a dig pass includes the steps of:

determining a position of a work implement during the digging operation, the work implement having known dimensions; and determining a quantity of removed ground during the dig pass as a function of the determined position and the known dimensions of the work implement.

4. A method, as set forth in claim 3, further including the step of controlling the position of the work implement as a function of the region of uncertainty.

5. A method, as set forth in claim 3, further including the step of displaying at least one of the work implement, the underground object, and the region of uncertainty relative to the ground.

6. A method, as set forth in claim 1, wherein performing at least one process includes the steps of:

delivering a signal from a plurality of locations toward the underground object;

receiving a corresponding plurality of reflected signals from the underground object; and superimposing the plurality of reflected signals to determine a three-dimensional determination of a location of the underground object, and to determine an estimate of a size and shape of the underground object.

7. A method, as set forth in claim 6, wherein the delivered signal is delivered from a work implement as the work implement moves to perform a dig pass.

8. A method, as set forth in claim 6, wherein the delivered signal is delivered from a plurality of fixed locations.

9. A method, as set forth in claim 1, wherein performing at least one process includes the steps of:

delivering a plurality of signals from a plurality of locations toward the underground object;

receiving a corresponding plurality of reflected signals from the underground object; and superimposing the plurality of reflected signals to determine a three-dimensional determination of a location of the underground object, and to determine an estimate of a size and shape of the underground object.

10. A method, as set forth in claim 1, wherein delivering a signal includes the step of delivering a ground penetrating radar signal.

11. An apparatus for determining a location of an underground object during a digging operation, comprising:

means for delivering a signal toward the underground object and for receiving a corresponding reflected signal from the underground object; and a controller for determining an initial location of the underground object, creating a region of uncertainty around the underground object as a function of a level of confidence of the determined initial location, performing at least one process to improve the level of confidence, and adjusting the region of uncertainty as a function of the improved level of confidence.

12. An apparatus, as set forth in claim 11, wherein the controller is further for:

a) estimating a first value of dielectric constant of the ground to be dug;

b) performing a first dig pass;

c) determining a first location of the underground object as a function of the estimated first value of dielectric constant and a known first quantity of removed ground;

d) performing a next dig pass;

e) determining a next location of the underground object as a function of the estimated value of dielectric constant and a next known quantity of removed ground;

f) determining an improved value of dielectric constant as a function of a comparison of the current determined location and a previous determined location; and g) repeating steps d) through f) for each subsequent dig pass.

13. An apparatus, as set forth in claim 12, further including a position determining system for determining a position of a work implement during the digging operation, the work implement having known dimensions, and wherein the controller is further for determining a quantity of removed ground during the dig pass as a function of the determined position and the known dimensions of the work implement.

14. An apparatus, as set forth in claim 13, wherein the controller is further for controlling the position of the work implement as a function of the region of uncertainty.

15. An apparatus, as set forth in claim 13, further including a display for displaying at least one of the work implement, the underground object, and the region of uncertainty relative to the ground.

16. An apparatus, as set forth in claim 11, wherein the controller is further for:

delivering a signal from a plurality of locations toward the underground object;

receiving a corresponding plurality of reflected signals from the underground object; and superimposing the plurality of reflected signals to determine a three-dimensional determination of a location of the underground object, and to determine an estimate of a size and shape of the underground object.

17. An apparatus, as set forth in claim 16, wherein the means for delivering a signal and for receiving a corresponding reflected signal includes a ground penetrating radar (GPR) antenna.

18. An apparatus, as set forth in claim 17, wherein the GPR antenna is mounted on the work implement.

19. An apparatus, as set forth in claim 11, wherein the controller is further for:

delivering a plurality of signals from a plurality of locations toward the underground object;

receiving a corresponding plurality of reflected signals from the underground object; and superimposing the plurality of reflected signals to determine a three-dimensional determination of a location of the underground object, and to determine an estimate of a size and shape of the underground object.

20. An apparatus, as set forth in claim 19, wherein the means for delivering a signal and for receiving a corresponding reflected signal includes a plurality of ground penetrating radar (GPR) antennas located at a plurality of predetermined locations to deliver a corresponding plurality of signals.

* * * * *